US012359328B2

(12) United States Patent
Fukuchi et al.

(10) Patent No.: US 12,359,328 B2
(45) Date of Patent: Jul. 15, 2025

(54) ANODE FOR ELECTROLYTIC SYNTHESIS AND METHOD FOR PRODUCING FLUORINE GAS OR FLUORINE CONTAINING COMPOUND

(71) Applicant: SHOWA DENKO K.K., Tokyo (JP)

(72) Inventors: Yohsuke Fukuchi, Tokyo (JP); Katsumi Mikami, Tokyo (JP); Hiroshi Kobayashi, Tokyo (JP)

(73) Assignee: Resonac Corporation, Tokyo (JP)

( * ) Notice: Subject to any disclaimer, the term of this patent is extended or adjusted under 35 U.S.C. 154(b) by 793 days.

(21) Appl. No.: 17/263,616

(22) PCT Filed: Jul. 19, 2019

(86) PCT No.: PCT/JP2019/028482

§ 371 (c)(1),
(2) Date: Jan. 27, 2021

(87) PCT Pub. No.: WO2020/026854

PCT Pub. Date: Feb. 6, 2020

(65) Prior Publication Data

US 2021/0292923 A1 Sep. 23, 2021

(30) Foreign Application Priority Data

Aug. 3, 2018 (JP) ..... 2018-146785

(51) Int. Cl.
*C25B 11/075* (2021.01)
*C25B 1/245* (2021.01)
(Continued)

(52) U.S. Cl.
CPC ..... *C25B 11/075* (2021.01); *C25B 1/245* (2013.01); *C25B 1/50* (2021.01); *C25B 11/065* (2021.01)

(58) Field of Classification Search
None
See application file for complete search history.

(56) References Cited

U.S. PATENT DOCUMENTS 2,534,638 A 12/1950 Swinehart
5,744,022 A 4/1998 Miller
(Continued)

FOREIGN PATENT DOCUMENTS

CN 101220485 A 7/2008
CN 101328592 A 12/2008
(Continued)

OTHER PUBLICATIONS

Danaee et al. (International Journal of hydrogen energy 33 '2008' 4367-4376). (Year: 2008).*
(Continued)

*Primary Examiner* — Wojciech Haske
(74) *Attorney, Agent, or Firm* — Sughrue Mion, PLLC

(57) ABSTRACT

There is provided an anode for electrolytic synthesis capable of electrolytically synthesizing fluorine gas or a fluorine containing compound by a simple process and at a low cost while suppressing the occurrence of an anode effect. An anode for electrolytic synthesis (3) for electrolytically synthesizing fluorine gas or a fluorine containing compound includes an anode substrate formed of a carbonaceous material and a metal coating film coating the anode substrate. Metal constituting the metal coating film is nickel.

6 Claims, 2 Drawing Sheets

(51) Int. Cl.
*C25B 1/50* (2021.01)
*C25B 11/065* (2021.01)

(56) References Cited

U.S. PATENT DOCUMENTS

| | | | | |
|---|---|---|---|---|
| 6,146,506 | A * | 11/2000 | Bauer | C25B 1/245 204/290.11 |
| 6,326,098 | B1 * | 12/2001 | Itoh | H01M 4/921 429/525 |
| 8,349,164 | B2 | 1/2013 | Furuta et al. | |
| 9,238,872 | B2 | 1/2016 | Mori et al. | |
| 2006/0219570 | A1 | 10/2006 | Furuta et al. | |
| 2008/0314759 | A1 * | 12/2008 | Furuta | C25B 11/075 205/556 |
| 2013/0341202 | A1 | 12/2013 | Mori et al. | |

FOREIGN PATENT DOCUMENTS

| | | | |
|---|---|---|---|
| CN | 103429790 | A | 12/2013 |
| GB | 2 135 335 | A | 8/1984 |
| JP | 60-221591 | A | 11/1985 |
| JP | 4-100262 | U | 8/1992 |
| JP | 2000-313981 | | 11/2000 |
| JP | 3893397 | B2 | 3/2007 |
| JP | 2009-001877 | A | 1/2009 |
| JP | 2009-215578 | A | 9/2009 |

OTHER PUBLICATIONS

Tetsuro Tojo et al., "Electrolytic Process of Fluorine, Advances in Science and Technology", Denki Kagaku = Electrochemistry, vol. 66, No. 5, 1998, pp. 563-567 (5 pages).

Extended European Search Report dated Aug. 30, 2021, issued by the European Patent Office in application No. 19844681.7.

International Preliminary Report on Patentability with translation of Written Opinion dated Feb. 9, 2021, in International Application No. PCT/JP2019/028482.

R. C. Downing, et al., "Electrolytic cells for production of Fluorine", Industrial and Engineering Chemistry, Mar. 1947, pp. 259-262 (4 pages), vol. 39, No. 3.

International Search Report for PCT/JP2019/028482 dated Aug. 27, 2019 (PCT/ISA/210).

* cited by examiner

ANODE FOR ELECTROLYTIC SYNTHESIS AND METHOD FOR PRODUCING FLUORINE GAS OR FLUORINE CONTAINING COMPOUND

CROSS REFERENCE TO RELATED APPLICATIONS

This application is a National Stage of International Application No. PCT/JP2019/028482 filed Jul. 19, 2019, claiming priority based on Japanese Patent Application No. 2018-146785 filed Aug. 3, 2018.

TECHNICAL FIELD

The present invention relates to an anode for electrolytically synthesizing fluorine gas or a fluorine containing compound and a method for producing fluorine gas or a fluorine containing compound.

BACKGROUND ART

Fluorine gas and a fluorine containing compound (for example, nitrogen trifluoride) can be synthesized by electrolyzing (electrolytic synthesis) an electrolytic solution containing fluoride ions. In the electrolytic synthesis, a carbon electrode has been generally used as an anode. However, the use of the carbon electrode has posed a problem that a voltage of an electrolytic cell required to obtain a predetermined current becomes a high voltage exceeding 12 V even when electrolyzed with an extremely low current density in some cases. This phenomenon is referred to as an anode effect.

A cause of the occurrence of the anode effect is as follows. When the electrolytic solution is electrolyzed, fluorine gas generated on the surface of the anode reacts with the carbon forming the anode, and therefore a coating film having a covalently bonded carbon-fluorine bond is formed on the surface of the anode. The coating film have insulation properties and poor wettability with the electrolytic solution, and therefore a current becomes difficult to flow to the anode, so that the anode effect occurs. Then, when the anode effect progresses, continuous electrolysis becomes impossible in some cases. In order to enable the use of the anode whose surface is coated with the insulating coating film for the electrolytic synthesis, it is necessary to polish the surface to remove the coating film.

NPL 1 discloses a technology of suppressing the anode effect by adding lithium fluoride or aluminum fluoride to an electrolytic solution containing hydrogen fluoride or by performing pre-electrolysis (conditioning) using a nickel electrode to reduce the moisture amount in an electrolytic solution.

Further, PTL 1 discloses an anode for electrolysis having a conductive substrate containing a conductive carbonaceous material, a conductive carbonaceous coting film having a diamond structure coated on a part of the conductive substrate, and a carbonaceous coting film containing (CF), coated on another portion of the conductive substrate.

When the electrolytic solution contains much moisture, oxidized graphite is generated by a reaction between the moisture and a conductive carbonaceous material portion having a non-diamond structure during the electrolysis, and then the oxidized graphite easily reacts with fluorine gas, so that a carbonaceous coting film containing (CF), is generated. The conductive carbonaceous coting film having the diamond structure does not generate a covalently bonded carbon-fluorine bond unlike a carbon electrode having the non-diamond structure, and therefore an insulating coating film is hardly generated on the surface.

CITATION LIST

Patent Literature

PTL 1: JP 3893397

Non Patent Literature

NPL 1: "Industrial & Engineering Chemistry", (U.S.), 1947, Vol. 39, pp. 259 to 262

SUMMARY OF INVENTION

Technical Problem

However, the technology disclosed in NPL 1 requires the change of the nickel electrode to a carbon electrode after performing the pre-electrolysis, and therefore has posed a problem that an electrolytic synthesis step has become complicated. Further, the anode for electrolysis disclosed in PTL 1 requires the formation of the coating film using a special material of the conductive carbon having the diamond structure, and therefore has a posed problem that the anode for electrolysis is expensive.

It is an object of the present invention to provide an anode for electrolytic synthesis capable of electrolytically synthesizing fluorine gas or a fluorine containing compound by a simple process and at a low cost while suppressing the occurrence of an anode effect and a method for producing fluorine gas or a fluorine containing compound.

Solution to Problem

In order to solve the problems, one aspect of the present invention is as described in [1] to [5] below.

[1] An anode for electrolytic synthesis for electrolytically synthesizing fluorine gas or a fluorine containing compound includes an anode substrate formed of a carbonaceous material and a metal coating film coating the anode substrate, in which metal constituting the metal coating film is nickel.

[2] The anode for electrolytic synthesis according to [1] above, in which the mass of the nickel constituting the metal coating film is 0.03 mass % or more and 0.4 mass % or less of the mass of an electrolytic solution used for the electrolytic synthesis.

[3] The anode for electrolytic synthesis according to [1] or [2] above, in which the mass of the nickel constituting the metal coating film is 0.01 g or more and 0.1 g or less per $cm^2$ of the surface of the anode substrate.

[4] A method for producing fluorine gas or a fluorine containing compound includes electrolyzing an electrolytic solution containing hydrogen fluoride using the anode for electrolytic synthesis according to any one of [1] to [3] above.

[5] A method for producing fluorine gas or a fluorine containing compound includes performing electrolysis of electrolyzing moisture contained in an electrolytic solution containing hydrogen fluoride, and then electrolyzing the electrolytic solution containing hydrogen fluoride using the anode for electrolytic synthesis according to any one of [1] to [3] above.

Advantageous Effects of Invention

The present invention can electrolytically synthesize fluorine gas or a fluorine containing compound by a simple process and at a low cost while suppressing the occurrence of an anode effect.

DESCRIPTION OF EMBODIMENTS

One embodiment of the present invention will now be described below. This embodiment gives an example of the present invention and the present invention is not limited to this embodiment. Further, this embodiment can be variously altered or modified and embodiments obtained by adding such alternations or modifications may also be included in the present invention.

Figure 1:
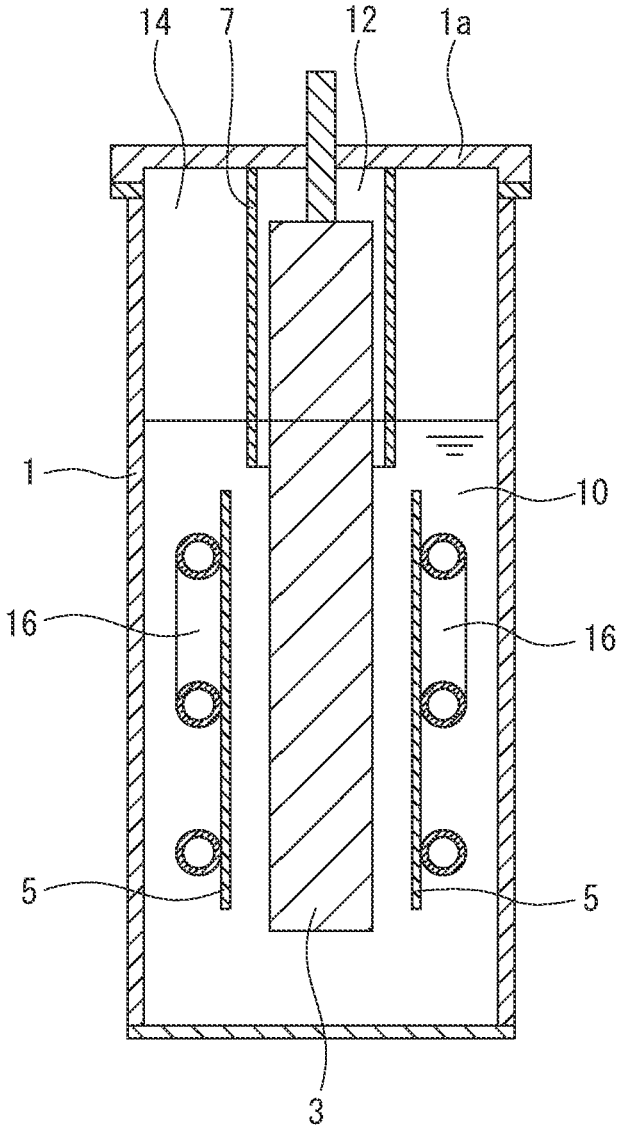
FIG. 1 is a cross-sectional view for explaining the structure of an electrolytic device including an anode for electrolytic synthesis according to one embodiment of the present invention.
Figure 2:
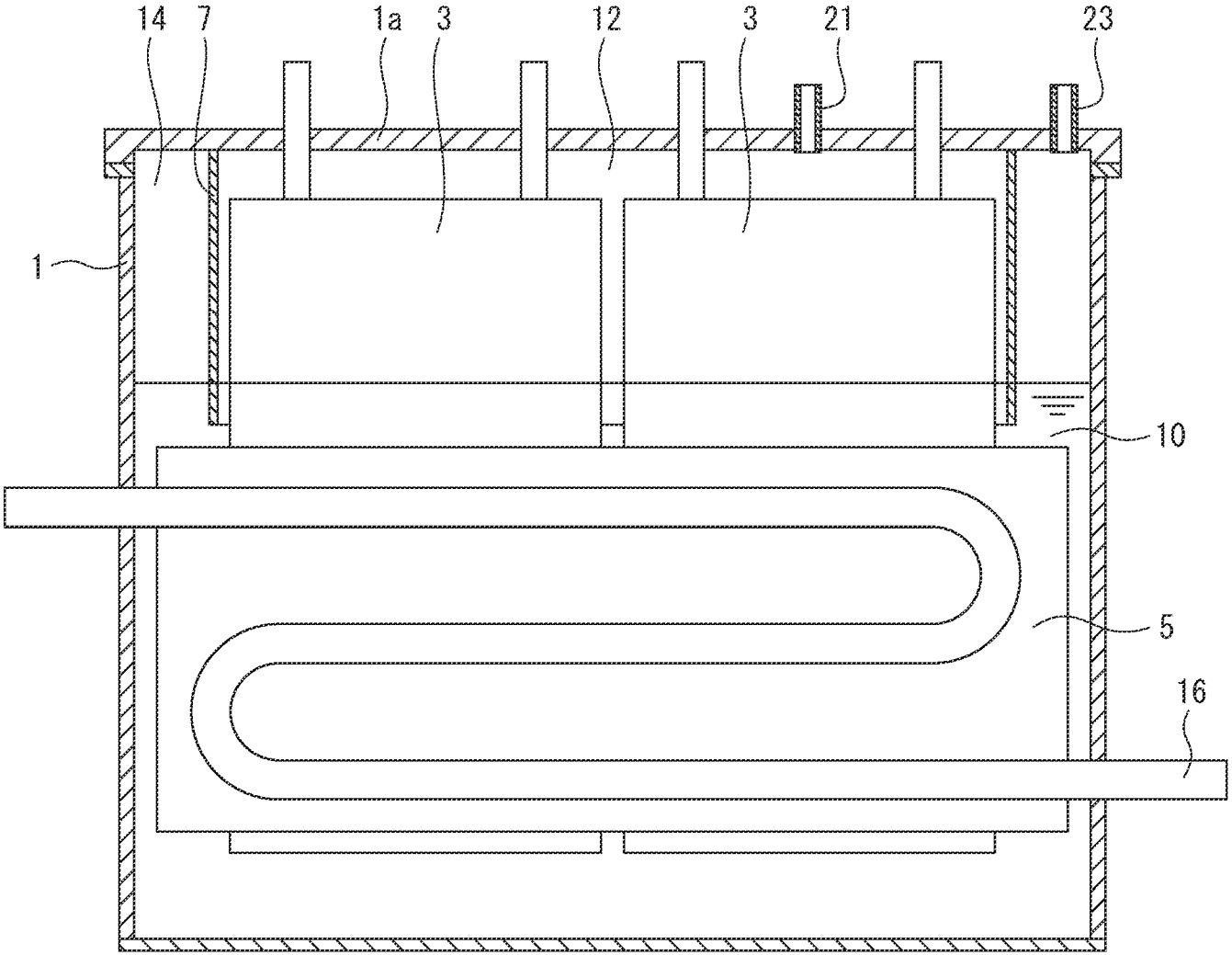
FIG. 2 is a cross-sectional view illustrating the electrolytic device of FIG. 1 virtually cut along a plane different from the plane in FIG. 1.

The structure of an electrolytic device including an anode for electrolytic synthesis according to this embodiment is described referring to FIG. 1 and FIG. 2. FIG. 1 is a cross-sectional view illustrating an electrolytic device virtually cut along a plane orthogonal to and parallel in the vertical direction to the plate surfaces of an anode for electrolytic synthesis 3 and cathodes for electrolytic synthesis 5 of the electrolytic device. FIG. 2 is a cross-sectional view illustrating the electrolytic device virtually cut along a plane parallel to and parallel in the vertical direction to the plate surfaces of the anode for electrolytic synthesis 3 and the cathodes for electrolytic synthesis 5 of the electrolytic device.

The electrolytic device illustrated in FIGS. 1, 2 includes an electrolytic cell 1 in which an electrolytic solution 10 is stored and the anode for electrolytic synthesis 3 and the cathodes for electrolytic synthesis 5 arranged in the electrolytic cell 1 and immersed in the electrolytic solution 10. The inside of the electrolytic cell 1 is partitioned into an anode chamber 12 and a cathode chamber 14 by a cylindrical partition 7 extending downward in the vertical direction from a lid 1*a* of the electrolytic cell 1. More specifically, an inner region surrounded by the cylindrical partition 7 is the anode chamber 12 and a region outside the cylindrical partition 7 is the cathode chamber 14.

The anode for electrolytic synthesis 3 is not limited in shape and may have a columnar shape and, in this example, has a plate shape. The anode for electrolytic synthesis 3 is arranged in the anode chamber 12 such that the plate surfaces thereof are parallel to each other in the vertical direction. The cathodes for electrolytic synthesis 5 are not limited in shape and may have a columnar shape and, in this example, have a plate shape. The cathodes for electrolytic synthesis 5 are arranged in the cathode chamber 14 such that the plate surfaces thereof are parallel to the plate surfaces of the anode for electrolytic synthesis 3 and the two cathodes for electrolytic synthesis 5, 5 interpose the anode for electrolytic synthesis 3 therebetween.

Further, on the plate surfaces opposite to the plate surfaces facing the anode for electrolytic synthesis 3 among both the front and rear plate surfaces of the cathodes for electrolytic synthesis 5, 5, cooling units for cooling the cathodes for electrolytic synthesis 5, 5 and the electrolytic solution 10 are mounted. In the example of the electrolytic device illustrated in FIGS. 1, 2, a cooling pipe 16 in which a cooling fluid flows is mounted as the cooling unit on each of the cathodes for electrolytic synthesis 5, 5.

As the anode for electrolytic synthesis 3, an electrode having the following configuration is usable. More specifically, an electrode is mentioned which includes an anode substrate formed of a carbonaceous material and a metal coating film coating the anode substrate and in which metal constituting the metal coating film is nickel. As a specific example, an electrode can be mentioned in which both the plate surfaces of the carbon electrode plate are coated with the metal coating film formed of nickel.

As the cathode for electrolytic synthesis 5, a metal electrode is usable and, for example, an electrode containing a nickel plate is usable.

As the electrolytic solution 10, a molten salt is usable and, for example, molten potassium fluoride (KF) containing hydrogen fluoride (HF) is usable.

For example, when a current is supplied between the anode for electrolytic synthesis 3 and the cathodes for electrolytic synthesis 5 using a mixed molten salt of hydrogen fluoride and potassium fluoride as the electrolytic solution, anode gas containing fluorine gas ($F_2$) as a main component is generated in the anode for electrolytic synthesis 3 and cathode gas containing hydrogen gas ($H_2$) as a main component is generated as a byproduct in the cathodes for electrolytic synthesis 5. By selecting the type of the electrolytic solution 10 as appropriate as described later, a fluorine containing compound, such as nitrogen trifluoride ($NF_3$), can be electrolytically synthesized in the anode for electrolytic synthesis 3.

The anode gas is accumulated in space above the liquid level of the electrolytic solution 10 in the anode chamber 12. The cathode gas is accumulated in space above the liquid level of the electrolytic solution 10 in the cathode chamber 14. Since the space above the liquid level of the electrolytic solution 10 is partitioned by the partition 7 into space in the anode chamber 12 and space in the cathode chamber 14, the anode gas and the cathode gas are not mixed. Meanwhile, in the electrolytic solution 10, while an upper portion relative to the lower end of the partition 7 is partitioned by the partition 7, a lower portion relative to the lower end of the partition 7 of the electrolytic solution 10 is not partitioned by the partition 7 and continuous.

Further, the anode chamber 12 is provided with an exhaust port 21 discharging the anode gas generated in the anode for electrolytic synthesis 3 from the inside of the anode chamber 12 to the outside of the electrolytic cell 1. The cathode chamber 14 is provided with an exhaust port 23 discharging the cathode gas generated in the cathodes for electrolytic synthesis 5, 5 from the inside of the cathode chamber 14 to the outside of the electrolytic cell 1.

As described above, the anode for electrolytic synthesis 3 of this embodiment includes the anode substrate formed of a carbonaceous material and the metal coating film coating the anode substrate. The metal coating film is made of nickel.

Since the anode substrate is coated with the metal coating film, a reaction between the fluorine gas generated in the anode for electrolytic synthesis 3 in the electrolytic synthesis and the carbonaceous material forming the anode substrate is hard to occur. Therefore, it is suppressed that the coating film having a covalently bonded carbon-fluorine bond is formed on the surface of the anode for electrolytic synthesis 3, and therefore an anode effect is hard to occur.

Further, in the case of the anode for electrolytic synthesis 3 of this embodiment, both the pre-electrolysis and the electrolytic synthesis can be performed. Therefore, in performing the electrolytic synthesis after performing the pre-electrolysis, there is no necessity of changing an anode for pre-electrolysis to an anode for electrolytic synthesis, and thus the pre-electrolysis and the electrolytic synthesis can be continuously performed. Hence, the use of the anode for electrolytic synthesis 3 of this embodiment enables the electrolytic synthesis of fluorine gas or a fluorine containing compound by a simple process.

Further, the metal coating film formed of nickel is not as expensive as a diamond coating film and is less expensive. Therefore, the use of the anode for electrolytic synthesis 3 of this embodiment enables the electrolytic synthesis of fluorine gas or a fluorine containing compound at a low cost.

As described above, when the electrolytic solution is electrolyzed using the anode for electrolytic synthesis 3 of this embodiment, fluorine gas or a fluorine containing compound (for example, nitrogen trifluoride) can be electrolytically synthesized by a simple process and at a low cost while suppressing the occurrence of the anode effect.

Further, fluorine containing compounds, such as uranium hexafluoride ($UF_6$), sulfur hexafluoride ($SF_6$), carbon tetrafluoride ($CF_4$), and nitrogen trifluoride, can also be chemically synthesized using the electrolytically synthesized fluorine gas as a starting material. The fluorine gas or the fluorine containing compounds, such as uranium hexafluoride, sulfur hexafluoride, carbon tetrafluoride, and nitrogen trifluoride, are useful in the nuclear industry field, the semiconductor industry field, the pharmaceutical and agrochemical field, the consumer product field, and the like.

Hereinafter, the anode for electrolytic synthesis according to this embodiment and the method for producing fluorine gas or a fluorine containing compound using the same are described in more detail.

(1) Electrolytic Cell

Although a material of an electrolytic cell performing electrolytic synthesis is not particularly limited, it is preferable to use copper, soft steel, nickel alloys, such as Monel (Trademark), fluororesin, and the like from the viewpoint of corrosion resistance.

In order to prevent the mixing of fluorine gas or a fluorine containing compound electrolytically synthesized by an anode for electrolytic synthesis and hydrogen gas generated in a cathode for electrolytic synthesis, an anode chamber where the anode for electrolytic synthesis is arranged and a cathode chamber where the cathode for electrolytic synthesis is arranged is entirely or partially partitioned by a partition, a diaphragm, or the like as in the electrolytic device illustrated in FIGS. 1, 2.

(2) Electrolytic Solution

An example of an electrolytic solution used when the fluorine gas is electrolytically synthesized is described. When the fluorine gas is electrolytically synthesized, a mixed molten salt of hydrogen fluoride and potassium fluoride is usable as the electrolytic solution. The molar ratio of the hydrogen fluoride and the potassium fluoride in the electrolytic solution is preferably 1.8 or more and 2.2 or less and more preferably 1.9 or more and 2.1 or less as a value of (Number of moles of hydrogen fluoride)/(Number of moles of potassium fluoride) and can be set to 2:1, for example.

Next, an example of an electrolytic solution used when the fluorine containing compound is electrolytically synthesized is described. When the fluorine containing compound is electrolytically synthesized, a mixed molten salt of a compound having a chemical structure before fluorination of a fluorine containing compound to be synthesized, hydrogen fluoride, and potassium fluoride is usable as the electrolytic solution. The electrolytic synthesis may be performed by forming the compound having the chemical structure before fluorination into a gaseous state, and then blowing the compound formed into the gaseous state into a mixed molten salt of hydrogen fluoride and potassium fluoride or the electrolytic synthesis may be performed using an electrolytic solution in which the compound having the chemical structure before fluorination is dissolved into a mixed molten salt of hydrogen fluoride and potassium fluoride.

The compound having the chemical structure before fluorination reacts with fluorine gas generated in a reaction in the anode for electrolytic synthesis to be a fluorine containing compound.

For example, when nitrogen trifluoride is electrolytically synthesized, a mixed molten salt of hydrogen fluoride and ammonium fluoride ($NH_4F$) or a mixed molten salt of hydrogen fluoride, potassium fluoride, and ammonium fluoride is usable as the electrolytic solution. Alternatively, a mixed molten salt of hydrogen fluoride and cesium fluoride (CsF) and a mixed molten salt of hydrogen fluoride, potassium fluoride, and cesium fluoride are also usable as the electrolytic solution for nitrogen trifluoride synthesis by the addition of ammonium fluoride.

In the case of the mixed molten salt of hydrogen fluoride and ammonium fluoride, the molar ratio of the hydrogen fluoride and the ammonium fluoride in the electrolytic solution is preferably 1.8 or more and 2.2 or less and more preferably 1.9 or more and 2.1 or less as a value of (Number of moles of hydrogen fluoride)/(Number of moles of ammonium fluoride) and can be set to 2:1, for example.

In the case of the mixed molten salt of hydrogen fluoride, potassium fluoride, and ammonium fluoride, the molar ratio of the hydrogen fluoride and the total of the potassium fluoride and the ammonium fluoride in the electrolytic solution is preferably 1.8 or more and 2.2 or less and more preferably 1.9 or more and 2.1 or less as a value of (Number of moles of hydrogen fluoride)/(Total number of moles of potassium fluoride and ammonium fluoride) and can be set to 2:1, for example. In this case, the molar ratio of the potassium fluoride and the ammonium fluoride is 1/9 or more and 1/1 or less as a value of (Number of moles of potassium fluoride)/(Number of moles of ammonium fluoride).

The compositions of the electrolytic solutions containing cesium fluoride may be set as follows. More specifically, the molar ratio of the cesium fluoride and the hydrogen fluoride in the electrolytic solution may also be set to 1:1.0 to 4.0. The molar ratio of the cesium fluoride, the hydrogen fluoride, and the potassium fluoride in the electrolytic solution may also be set to 1:1.5 to 4.0:0.01 to 1.0.

The electrolytic solution containing hydrogen fluoride generally contains moisture in a proportion of 0.1 mass % or more and 5 mass % or less. When the moisture contained in the electrolytic solution containing hydrogen fluoride exceeds 3 mass %, the electrolytic solution containing hydrogen fluoride may be used as the electrolytic solution after the moisture contained in the electrolytic solution containing hydrogen fluoride is reduced to 3 mass % or less by a method described in JP 7-2515 A, for example. In general, it is difficult to simply reduce the moisture amount in the electrolytic solution containing hydrogen fluoride. Therefore, when fluorine gas or a fluorine containing compound is electrolytically synthesized in an industrial manner, it is preferable to use an electrolytic solution having a moisture content of 3 mass % or less from the viewpoint of cost.

(3) Cathode for Electrolytic Synthesis

As described above, a metal electrode is usable as the cathode for electrolytic synthesis. Examples of the types of the metal constituting the metal electrode include iron, copper, and nickel alloy, for example.

(4) Anode for Electrolytic Synthesis

The anode for electrolytic synthesis of this embodiment is described in detail taking an anode for electrolytic synthesis suitable in electrolytically synthesizing fluorine gas as an example.

When the electrolytic synthesis is performed in an electrolytic solution containing a molten salt containing moisture using a conventional anode for electrolytic synthesis containing a carbonaceous material, such as graphite or amorphous carbon, the moisture contained in the electrolytic solution is electrolyzed, so that oxygen gas is generated while fluorine gas is generated in the anode.

Although the oxygen gas is collected in a gaseous state as with fluorine gas, the oxygen gas partially reacts with the carbonaceous material on the surface of the anode before collected. Then, oxygen reacting with the carbonaceous material is replaced with fluorine to be collected as oxygen gas. As a result of this reaction, an insulating coating film having the covalently bonded carbon-fluorine bond is formed on the surface of the carbonaceous material, so that the anode effect occurs.

On the other hand, in the anode for electrolytic synthesis of this embodiment, a portion formed of the carbonaceous material is coated with the metal coating film containing nickel. However, oxygen gas does not react with metal as easily as the carbonaceous material and, even when reacting, the oxygen gas continuously reacts with fluorine gas, and therefore the resultant gas is collected as oxygen gas. Meanwhile, the metal coating film of the anode for electrolytic synthesis becomes metal fluoride as the electrolytic synthesis continues. Then, the generated metal fluoride is desorbed from the surface of the anode for electrolytic synthesis.

Through the above-described steps, the moisture contained in the electrolytic solution is decomposed, and then collected as oxygen gas in the anode for electrolytic synthesis and collected as hydrogen gas in the cathode for electrolytic synthesis, and therefore the moisture is removed from the electrolytic solution. During this time, an insulating coating film is not formed on the metal coating film of the anode for electrolytic synthesis of this embodiment, and the metal coating film is peeled. When the electrolytic synthesis of fluorine gas is continued as described above, the metal coating film is sufficiently peeled, so that the carbonaceous material in a lower layer appears on the surface (this step is equivalent to the pre-electrolysis described in NPL 1). Then, at this stage, the moisture amount in the electrolytic solution is sufficiently reduced. More specifically, when the pre-electrolysis is performed using the anode for electrolytic synthesis of this embodiment, the moisture amount in the electrolytic solution can be sufficiently reduced by the above-described simple operation.

The moisture amount in the electrolytic solution is sufficiently low, and therefore, even when the generation of fluorine gas starts on the surface of the carbonaceous material newly appearing on the surface of the anode for electrolytic synthesis of this embodiment in continuing the electrolytic synthesis, a high anode effect does not occur. Hence, a problem that a voltage increases does not occur, and therefore the electrolytic synthesis of fluorine gas can be efficiently continued. Further, a complicated operation of exchanging the anodes for electrolytic synthesis between the pre-electrolysis and the electrolytic synthesis is unnecessary, and both the pre-electrolysis and the electrolytic synthesis of fluorine gas can be performed by one anode for electrolytic synthesis.

In order to obtain such an operational effect, it is preferable to form the metal coating film with metal having a property of desorbing from the anode for electrolytic synthesis without forming a passive state even when reacting with fluorine gas. As such metal, nickel is effective. As the metal constituting the metal coating film, nickel may be used alone or two or more types may be used in combination by adding other types of metals to nickel. When two or more types of metals are used, a metal coating film may be formed of an alloy of the metals or metal coating films formed of the metals may be individually coated on the surface of the anode substrate of the anode for electrolytic synthesis. Further, a metal coating film may be formed of an alloy containing nickel in which a transition element is compounded. The addition of the transition element can suppress wear of the anode for electrolytic synthesis.

In producing the anode for electrolytic synthesis of this embodiment, the metal coating film is formed on the surface of the anode substrate formed of a carbonaceous material. A method for forming the metal coating film is not particularly limited and electrolytic plating, electroless plating, electric arc wire spraying, and wire flame spraying and, further, vacuum film deposition methods, such as a vapor deposition and a sputtering method, are usable. Among the methods, electrolytic plating and electroless plating are preferable due to simplicity.

The metal coating film is preferably formed so as to coat at least one part of a portion formed of the carbonaceous material of the anode substrate and more preferably formed so as to entirely coat the portion formed of the carbonaceous material.

When the anode for electrolytic synthesis exists also in a power supply portion receiving power, an effect of preventing contact resistance is also expectable. When there is a portion where the metal coating film does not exist in a portion contacting the electrolytic solution of the surface of the anode for electrolytic synthesis, a carbonaceous coating film containing (CF) n is generated in the portion formed of the carbonaceous material with the progress of electrolysis, so that an insulating state is formed. On the other hand, when the metal coating film is formed, a portion where the metal coating film is formed allows the passage of a current, and therefore the electrolysis progresses. As a result, when the moisture amount in the electrolytic solution has decreased, the metal coating film is peeled, so that the carbonaceous material of the lower layer appears on the surface. Then, the electrolytic synthesis progresses on the surface of the carbonaceous material which has newly appeared, and therefore the electrolytic synthesis can be satisfactorily continued.

As the carbonaceous material used for the anode substrate, graphite, amorphous carbon, carbon nanotube, graphene, a conductive single crystal diamond, a conductive polycrystalline diamond, a conductive diamond-like carbon, and the like usually used for electrolysis are usable. The shape of the carbonaceous material is not particularly limited and is preferably a plate shape because the power supply portion is easily attached.

Insofar as the portion containing the carbonaceous material exists in the lower layer of the metal coating film, a portion containing a less-resistant material may be provided or a portion containing other materials for imparting strength may be provided in a further lower layer of the portion containing the carbonaceous material in the anode substrate.

The mass of the nickel which is the metal constituting the metal coating film is preferably 0.01 g or more and 0.1 g or less per cm' of the surface formed of the carbonaceous material of the anode substrate. When the mass of the nickel is within the range above, it is avoided that the nickel is dissolved before performing pre-electrolysis of the moisture in the electrolytic solution, so that the carbonaceous material of the base appears. Therefore, the covalently bonded carbon-fluorine bond causing an anodization phenomenon or anodic polarization is hard to be formed on the surface of the carbonaceous material. Further, a risk is also reduced that the dissolved nickel amount is excessively large, so that the dissolved nickel is returned by a cathode and deposited as sludge of fluoride in the electrolytic cell. To that end, the mass of the nickel is more preferably 0.03 g or more and 0.07 g or less per $cm^2$ of the surface formed of the carbonaceous material of the anode substrate.

Further, the mass of the nickel which is the metal constituting the metal coating film is preferably 0.03 mass % or more and 0.4 mass % or less of the mass of the electrolytic solution used for the electrolytic synthesis. When the mass of the nickel is within the range above, it is avoided that the nickel is dissolved before performing pre-electrolysis of the moisture in the electrolytic solution, so that the carbonaceous material of the base appears. Therefore, the covalently bonded carbon-fluorine bond causing an anodization phenomenon or anodic polarization is hard to be formed on the surface of a carbonaceous material. Further, a risk is also reduced that the dissolved nickel amount is excessively large, so that the dissolved nickel is returned by a cathode and deposited as sludge of fluoride in the electrolytic cell. To that end, the mass of the nickel is more preferably 0.1 mass % or more and 0.2 mass % or less.

The surface area (apparent surface area determined by measurement) of the portion where a current flows in the electrolytic synthesis of the anode coated with the metal coating film containing nickel is preferably 20 $cm^2$ or more and 100 $cm^2$ or less based on the capacity, 1 L, of the electrolytic solution. When the surface area of the portion where a current flows is within the range above, time until the moisture in the electrolytic solution is removed by the pre-electrolysis is not prolonged, so that a risk that economic efficiency decreases is also reduced. Further, the distance between the anode for electrolytic synthesis and the cathode for electrolytic synthesis can be moderately kept and a reduction in current efficiency or economic efficiency is hard to occur.

As the anode for electrolytic synthesis installed in the electrolytic cell, an electrode whose entire surface is coated with nickel is preferably installed. However, depending on the structure of the electrolytic cell, a method may be employed which includes installing an electrode coated with nickel and an electrode not coated with nickel, performing standby without applying a current to the electrode not coated with nickel after the completion of pre-electrolysis, and then, after the completion of the pre-electrolysis, applying a current to the electrode not coated with nickel.

In the pre-electrolysis, the electrolysis may be performed with a current density of 0.001 A/cm or more and 5 A/cm' or less. Thus, the moisture in the electrolytic solution is removed. The completion of the removal of the moisture in the electrolytic solution can be known by the measurement of the oxygen gas amount in fluorine gas to be generated. Further, the completion of the removal of the moisture in the electrolytic solution can also be known by a change in a bath voltage as the metal coating film is peeled and replaced with the surface of the carbonaceous material. When the nickel which is the metal constituting the metal coating film is worn, so that the carbonaceous material appears on the surface, the bath voltage decreases.

EXAMPLES

Hereinafter, the present invention is more specifically described by giving Examples and Comparative Examples.

Comparative Example 1

An electrolytic device having the same configuration as that of the electrolytic device illustrated in FIGS. 1, 2 was prepared. However, two carbon electrode plates were used for anodes. The dimension of the carbon electrode plate is 45 cm in length, 28 cm in width, and 7 cm in thickness. The anode and a lid of an electrolytic cell are electrically insulated. A body of the electrolytic cell and a Monel metal plate are used as cathodes. The body of the electrolytic cell and the Monel metal plate are conductive to each other (not illustrated). Further, the body and the lid of the electrolytic cell are electrically insulated. To the Monel metal plate, a cooling pipe is welded. In order to prevent the generation of hydrogen from the bottom surface inside the body of the electrolytic cell, a Teflon (Registered Trademark) plate is placed on the bottom surface. The area of a portion where a current flows of the anode is 2800 $cm^2$ (25 cm×28 cm×4 cm). Hydrogen fluoride in an electrolytic solution is consumed by the electrolysis. Therefore, it is configured so that the electrolytic solution is supplied to the electrolytic cell such that the liquid level of the electrolytic solution is fixed. By controlling the moisture amount of the electrolytic solution to be supplied at a low level at this time, an increase in the moisture amount in the system can be suppressed.

As the electrolytic solution, 58 L (111 kg) of a mixed molten salt (KF·2HF) of potassium fluoride and hydrogen fluoride was used. The moisture amount in the electrolytic solution is 2.4 mass % (2.66 kg) as measured by the Karl Fischer method. The electrolytic solution was poured into the electrolytic cell, and the temperature of the electrolytic solution was controlled at 90° C. by heating with an external heater and cooling by the cooling pipe where 65° C. warm water was circulated.

On each of the carbon electrode plates exposed to space above the liquid level of the electrolytic solution inside an anode chamber, a Viton (Trademark) sheet (1 cm in length, 2 cm in width, and 0.5 cm in thickness) which is a fluorinated hydrocarbon polymer was placed as a test piece. The composition of gas to be generated can be estimated by a change in the state of this sheet. More specifically, it is empirically known that, in the electrolysis temperature atmosphere, the sheets are burned out when sufficient fluorine gas and an adequate amount of oxygen gas coexist and the sheet does not change when the fluorine gas amount is small or when oxygen gas hardly exists even when sufficient fluorine gas exists.

When a 28A (current density of 0.01 $A/cm^2$) direct current was applied to the electrolytic device, the cell voltage around 2 V was exhibited for a while, and then the cell voltage increased to 5 V. Therefore, the current application was performed as it was for 1 hour. Subsequently, when the direct current was increased to 56 A (current density of 0.02 A/cm$^2$) and the current application was performed for 1 hour, the cell voltage increased to 8 V. When the direct current was increased to 84 A (current density of 0.03 A/cm$^2$) and the current application was performed for 1 hour, the cell voltage increased to 10 V. Further, when the direct current was increased to 112 A (0.04 A/cm$^2$), the cell voltage exhibited a value exceeding 12 V. Therefore, the current application was stopped. The direct current was reduced to 84 A and the current application was performed for 100 hours such that the cell voltage did not exceed 12 V.

After the current application of 8579 Ah, the lid of the electrolytic cell was opened. Then, the test pieces placed on the carbon electrode plates were burned out. It was assumed that a mixed gas of fluorine gas, oxygen gas, and hydrogen gas (in which sufficient fluorine gas and an adequate amount of oxygen gas coexist) was generated in the anode, and then ignited and burned. It is considered that the hydrogen gas was generated in the cathode, got over the partition, and then mixed to the anode side. The measurement of the moisture amount in the electrolytic solution showed that the moisture amount decreased by 1.22 kg to be 1.44 kg, and therefore it was found that 50% of the current application amount was used for the electrolysis of the moisture.

Comparative Example 2

Pre-electrolysis was performed in the same manner as in Comparative Example 1, except using carbon electrode plates whose surfaces were coated with a conductive diamond coating film as the anodes.

First, a direct current of 280 A (current density of 0.1 A/cm$^2$) was applied to the electrolytic device. However, the cell voltage did not exceed 12 V. Therefore, electrolysis was continued for 31 hours, so that the current application of 8680 Ah was performed.

After the current application of 8680 Ah, the lid of the electrolytic cell was opened. Then, the test pieces placed on the carbon electrode plates were burned out. It was assumed that a mixed gas fluorine gas, oxygen gas, and hydrogen gas was generated in the anode, and then ignited and burned. The measurement of the moisture amount in an electrolytic solution showed that the moisture amount decreased by 1.22 kg to be 1.44 kg, and therefore it was found that 49% of the current application amount was used for the electrolysis of the moisture.

Although the time for the pre-electrolysis was able to be shortened as compared with Comparative Example 1, the gas composition with high flammability (sufficient fluorine gas and an adequate amount of oxygen gas coexist) generated at the early stage of the electrolysis did not change, and thus an abnormal reaction was not be able to be suppressed.

Comparative Example 3

Pre-electrolysis was performed in the same manner as in Comparative Example 1, except using nickel plates as the anodes. The distance between the electrodes was set to be the same as that in the case of the carbon electrode plates. First, a direct current of 280 A (current density of 0.1 A/cm$^2$) was applied to the electrolytic device. However, the cell voltage did not exceed 12 V. Therefore, the electrolysis was continued for 31 hours, so that the current application of 8680 Ah was performed.

After the current application of 8680 Ah, the lid of the electrolytic cell was opened. Then, the test pieces placed on the nickel electrode plates did not change. The measurement of the moisture amount in the electrolytic solution showed that the moisture amount decreased 2.00 kg to be 0.66 kg. Therefore, it was found that 68% of the current application amount was used for the electrolysis of the moisture and it was found that the pre-electrolysis using the nickel electrode plates is effective.

The anode was exchanged from the nickel plates to new carbon electrode plates, and then a test piece was placed on each of the carbon electrode plates. Then, a direct current of 280 A (current density of 0.1 A/cm$^2$) was applied to the electrolytic device for electrolysis again. Then, when the current application of 500 kAh was performed, the cell voltage reached 12 V or more. Therefore, the current application was stopped. After the current application of 500 kAh, the lid of the electrolytic cell was opened. Then, the test pieces placed on the carbon electrode plates were burned out. It was assumed that moisture was mixed by work for exchanging the anodes.

Example 1

Pre-electrolysis was performed in the same manner as in Comparative Example 1, except using carbon electrode plates whose surfaces were coated with a metal coating film formed of nickel as the anodes. A metal coating film coated only a portion contacting the electrolytic solution (i.e., portion immersed in the electrolytic solution) of the carbon electrode plates. The metal coating film coated the carbon electrode plates by nickel electrolytic plating. After subjected to the nickel electrolytic plating, the carbon electrode plates were washed with water, and then sufficiently dried to be used as electrodes.

100 g of nickel was coated on one carbon electrode plate and an effective electrode area is 2800 cm$^2$, and therefore the plating amount is about 0.07 g per cm. Since there are two carbon electrode plates, the total amount of the nickel plated on the carbon electrode plates is 200 g, which is equivalent to 0.18 mass % of the mass of the electrolytic solution.

First, a direct current of 280 A (current density of 0.1 A/cm$^2$) was applied to the electrolytic device. However, the cell voltage did not exceed 12 V. Therefore, electrolysis was continued for 31 hours, so that the current application of 8680 Ah was performed. The measurement of the moisture amount in the electrolytic solution by sampling the electrolytic solution from a sampling port without opening the lid of the electrolytic cell showed that the moisture amount decreased by 2.00 kg to be 0.66 kg. Therefore, it was found that 68% of the current application amount was used for the electrolysis of the moisture.

When the electrolysis was continued by successively applying the direct current of 280 A (current density of 0.1 A/cm$^2$) to the electrolytic device, the cell voltage was 12 V or less even when the current application of 2000 kAh was performed. The analysis of anode gas generated in the anode during the electrolysis showed that most of the anode gas was fluorine gas and the concentration of oxygen in the anode gas was 0.05 volumes or less. Further, it was found that the current efficiency of the generation of the fluorine gas was 90%. At this time, the current application was stopped once, the lid of the electrolytic cell was opened, and then the state of the test pieces was checked. Then, no changes were observed and the metal coating film formed of nickel was dissolved.

After the metal coating film was dissolved, sufficient fluorine gas was generated by the electrolysis with the carbon electrode plates. However, oxygen gas generated before the dissolution of the metal coating film was almost discharged out of the system of the electrolytic device. Therefore, it is assumed that the oxygen gas hardly existed in space above the liquid level of the electrolytic solution inside the anode chamber.

A method for analyzing the anode gas is as follows. The fluorine gas in the anode gas was absorbed into a potassium iodide aqueous solution, and then separated iodine ($I_2$) was titrated using a sodium thiosulfate ($Na_2S_2O_3$) solution, whereby the identification and the measurement of the generation amount of the fluorine gas were performed. Further, the anode gas was passed through a sodium fluoride packed column, so that hydrogen fluoride in the anode gas was removed. Thereafter, the fluorine gas was converted into chlorine gas by sodium chloride, and then the chlorine gas in the obtained gas was removed with an adsorbent (NaOH). Then, the concentration of the oxygen gas in the anode gas was calculated by analyzing the residual gas by gas chromatography.

Example 2

Pre-electrolysis was performed in the same manner as in Example 1, except that conditions of nickel electrolytic plating performed when producing a carbon electrode plate which is the anode are different.

33 g of nickel is coated on effective area parts of two carbon electrode plates and an effective electrode area is 2800 $cm^2$, and therefore the plating amount is about 0.01 g per $cm^2$. The total amount of the nickel plated on the carbon electrode plates is 33 g, which is equivalent to 0.03 mass % of the mass of the electrolytic solution.

First, a direct current of 280 A (current density of 0.1 $A/cm^2$) was applied to the electrolytic device. However, the cell voltage did not exceed 12 V. Therefore, the electrolysis was continued for 31 hours, so that the current application of 8680 Ah was performed. The measurement of the moisture amount in the electrolytic solution by sampling the electrolytic solution from a sampling port without opening the lid of the electrolytic cell showed that the moisture amount decreased by 1.77 kg to be 0.89 kg. Therefore, it was found that 61% of the current application amount was used for the electrolysis of the moisture.

The electrolysis was continued by successively applying the direct current of 280 A (current density of 0.1 $A/cm^2$) to the electrolytic device. Then, the cell voltage was 12 V or less even when the current application of 2000 kAh was performed. The analysis of anode gas generated in the anode during the electrolysis showed that most of the anode gas was fluorine gas and the concentration of oxygen in the anode gas was 0.05 volumes or less. Further, it was found that the current efficiency of the generation of the fluorine gas was 90%. At this time, the current application was stopped once, the lid of the electrolytic cell was opened, and then the state of the test pieces was checked. Then, no changes were observed and the metal coating film formed of nickel was dissolved.

Example 3

Pre-electrolysis was performed in the same manner as in Example 1, except that conditions of nickel electrolytic plating performed when producing a carbon electrode plate which is the anode are different.

10 g of nickel is coated on an effective area part of one carbon electrode plate and an effective electrode area is 2800 $cm^2$, and therefore the plating amount is about 0.007 g per $cm^2$. Since there are two carbon electrode plates, the total amount of the nickel plated on the carbon electrode plates is 20 g, which is equivalent to 0.018 mass % of the mass of an electrolytic solution.

First, a direct current of 280 A (current density of 0.1 $A/cm^2$) was applied to the electrolytic device in the same manner as in Example 1. However, the cell voltage began to gradually increase at a stage where the electrolysis was continued for 10 hours, and then exceeded 11 V. Therefore, the electrolysis was once interrupted. The current application amount was 2800 Ah. The current value was reduced to 200 A (current density of 0.07 $A/cm^2$), and then the electrolysis was continued for 29 hours such that the voltage did not exceed 12 V, so that the current application of 5800 Ah was performed. The total current application of 8600 Ah was performed. The measurement of the moisture amount in the electrolytic solution by sampling the electrolytic solution showed that the moisture amount decreased by 1.66 kg to be 1.00 kg, and therefore it was found that 57% of the current application amount was used for the electrolysis of the moisture.

The electrolysis was continued by successively applying the direct current of 280 A (current density of 0.1 $A/cm^2$) to the electrolytic device. Then, the cell voltage exceeded 11 V but was 12 V or less, and therefore the current application of 500 kAh was performed. The analysis of anode gas generated in the anode during the electrolysis showed that most of the anode gas was fluorine gas and the concentration of oxygen in the anode gas was 0.05 volumes or less. Further, it was found that the current efficiency of the generation of the fluorine gas was 90%. At this time, the current application was stopped once, the lid of the electrolytic cell was opened, and then the state of the test pieces was checked. Then, no changes were observed and the metal coating film formed of nickel was dissolved.

Example 4

Pre-electrolysis was performed in the same manner as in Example 1, except that conditions of nickel electrolytic plating performed when producing a carbon electrode plate which is the anode are different.

500 g of nickel is coated on effective area parts of two carbon electrode plates and an effective electrode area is 2800 $cm^2$, and therefore the plating amount is about 0.18 g per $cm^2$. The total amount of the nickel plated on the carbon electrode plates is 500 g, which is equivalent to 0.45 mass % of the mass of the electrolytic solution.

First, a direct current of 280 A (current density of 0.1 $A/cm^2$) was applied to the electrolytic device. However, the cell voltage did not exceed 12 V. Therefore, the electrolysis was continued for 31 hours, so that the current application of 8680 Ah was performed. The measurement of the moisture amount in the electrolytic solution by sampling the electrolytic solution from a sampling port without opening the lid of the electrolytic cell showed that the moisture amount decreased by 2.00 kg to be 0.66 kg. Therefore, it was found that 68% of the current application amount was used for the electrolysis of the moisture.

The electrolysis was continued by successively applying the direct current of 280 A (current density of 0.1 $A/cm^2$) to the electrolytic device. Then, the cell voltage was 12 V or less even when the current application of 2000 kAh was performed. The analysis of anode gas generated in the anode during the electrolysis showed that most of the anode gas was fluorine gas and the concentration of oxygen in the anode gas was 0.05 volumes or less. Further, it was found that the current efficiency of the generation of the fluorine gas was 90%. At this time, the current application was stopped once, the lid of the electrolytic cell was opened, and then the state of the test pieces was checked. Then, although no changes were observed and the metal coating film formed of nickel was dissolved, a nickel fluoride sediment was deposited on a bottom portion of the electrolytic cell. The deposit did not contact the anode or the cathode. However, it was assumed that, when the deposit contacts the anode or the cathode due to an increase in the deposition amount, a short-circuit current flows, so that deteriorate the current efficiency of the electrolysis deteriorates.

Comparative Example 4

Pre-electrolysis was performed in the same manner as in Example 1, except that conditions of nickel electrolytic plating performed when producing a carbon electrode plate which is the anode are different.

10 g of nickel is coated on one carbon electrode plate and an effective electrode area is 2800 $cm^2$, and therefore the plating amount is about 0.007 g per $cm^2$. Since there are two carbon electrode plates, the total amount of the nickel plated on the carbon electrode plates is 20 g, which is equivalent to 0.018 mass % of the mass of the electrolytic solution.

A direct current of 280 A (current density of 0.1 $A/cm^2$) was applied to the electrolytic device in the same manner as in Example 1. However, the cell voltage began to gradually increase at the stage where the electrolysis was continued for 10 hours, and then exceeded 12 V. Therefore, the electrolysis was interrupted. It is assumed that the anode effect occurred. The current application amount was 2800 Ah.

The measurement of the moisture amount in the electrolytic solution by sampling the electrolytic solution showed that the moisture amount was 1.8 mass %, and therefore it was found that 70% of the current application amount was used for the electrolysis of the moisture. Although the electrolysis was attempted by successively applying the direct current of 280 A to the electrolytic device, the cell voltage exceeded 12 V. Therefore, the electrolysis was not able to be continued.

REFERENCE SIGNS LIST

1 electrolytic cell
3 anode for electrolytic synthesis
5 cathode for electrolytic synthesis
10 electrolytic solution

The invention claimed is:

1. An anode for electrolytic synthesis for electrolytically synthesizing fluorine gas or a fluorine containing compound,
the anode for electrolytic synthesis comprising:
an anode substrate formed of a carbonaceous material; and
a metal coating film entirely coating a portion formed of the carbonaceous material of the anode substrate, wherein
metal constituting the metal coating film is nickel,
at least a portion of the metal coating is contact with electrolytic solution, and
a mass of the nickel constituting the metal coating film is 0.01 g or more and 0.1 g or less per $cm^2$ of a surface of the anode substrate.

2. The anode for electrolytic synthesis according to claim 1, wherein
a mass of the nickel constituting the metal coating film is 0.03 mass % or more and 0.4 mass % or less of a mass of an electrolytic solution used for the electrolytic synthesis.

3. A method for producing fluorine gas or a fluorine containing compound comprising:
electrolyzing an electrolytic solution containing hydrogen fluoride using the anode for electrolytic synthesis according to claim 1.

4. A method for producing fluorine gas or a fluorine containing compound comprising:
performing pre-electrolysis of electrolyzing moisture contained in an electrolytic solution containing hydrogen fluoride, and then electrolyzing the electrolytic solution containing hydrogen fluoride using the anode for electrolytic synthesis according to claim 1.

5. A method for producing fluorine gas or a fluorine containing compound comprising:
electrolyzing an electrolytic solution containing hydrogen fluoride using the anode for electrolytic synthesis according to claim 2.

6. A method for producing fluorine gas or a fluorine containing compound comprising:
performing pre-electrolysis of electrolyzing moisture contained in an electrolytic solution containing hydrogen fluoride, and then electrolyzing the electrolytic solution containing hydrogen fluoride using the anode for electrolytic synthesis according to claim 2.

* * * * *